US009516714B2

(12) United States Patent
Kuwano et al.

(10) Patent No.: US 9,516,714 B2
(45) Date of Patent: Dec. 6, 2016

(54) LED LIGHTING DEVICE

(71) Applicants: Hirohisa Kuwano, Chiyoda-ku (JP); Takayoshi Nagai, Chiyoda-ku (JP); Tomokazu Sakashita, Chiyoda-ku (JP)

(72) Inventors: Hirohisa Kuwano, Chiyoda-ku (JP); Takayoshi Nagai, Chiyoda-ku (JP); Tomokazu Sakashita, Chiyoda-ku (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 42 days.

(21) Appl. No.: 14/377,567

(22) PCT Filed: Jan. 9, 2013

(86) PCT No.: PCT/JP2013/050238
§ 371 (c)(1),
(2) Date: Aug. 8, 2014

(87) PCT Pub. No.: WO2013/136823
PCT Pub. Date: Sep. 19, 2013

(65) Prior Publication Data

US 2015/0035444 A1 Feb. 5, 2015

(30) Foreign Application Priority Data

Mar. 16, 2012 (JP) ..... 2012-060082

(51) Int. Cl.
*H05B 37/02* (2006.01)
*H05B 33/08* (2006.01)

(52) U.S. Cl.
CPC ..... *H05B 33/083* (2013.01); *H05B 33/0809* (2013.01); *H05B 33/0815* (2013.01);
(Continued)

(58) Field of Classification Search
CPC ..... H05B 37/02; H05B 33/08
(Continued)

(56) References Cited

U.S. PATENT DOCUMENTS

2010/0264836 A1* 10/2010 Godbole ..... H05B 33/0827 315/185 R
2010/0283397 A1* 11/2010 Chen ..... H05B 33/0827 315/192
(Continued)

FOREIGN PATENT DOCUMENTS

| | | |
|---|---|---|
| JP | 2006-147184 | 6/2006 |
| JP | 2012-004054 | 1/2012 |
| WO | 2011/152480 | 12/2011 |

OTHER PUBLICATIONS

Combined Office Action and Search Report issued on Jun. 1, 2015 in Chinese Patent Application No. 201380014511.2 with partial English translation and English translation of category of documents.

(Continued)

*Primary Examiner* — Tung X Le
(74) *Attorney, Agent, or Firm* — Oblon, McClelland, Maier & Neustadt, L.L.P.

(57) ABSTRACT

A control circuit performs ON/OFF control for a switching element so that LED current flowing in an LED unit is within a rated current range. In the case where the LED unit is lit, a voltage applied between both ends of series connection of a reactor and the LED unit becomes a first bus voltage, when the switching element is ON, and becomes a voltage lower than the first bus voltage, that is determined based on the first bus voltage and a second bus voltage, when a switching element is OFF.

11 Claims, 13 Drawing Sheets

(52) U.S. Cl.
CPC ..... *H05B 33/0827* (2013.01); *H05B 33/0842* (2013.01); *H05B 37/02* (2013.01)

(58) Field of Classification Search
USPC ..... 315/185 R, 186, 192, 291, 294, 312
See application file for complete search history.

(56) References Cited

U.S. PATENT DOCUMENTS

| | | | | |
|---|---|---|---|---|
| 2011/0062889 | A1* | 3/2011 | Hoogzaad | G09G 3/342 315/294 |
| 2012/0032613 | A1 | 2/2012 | Liu et al. | |
| 2013/0015774 | A1* | 1/2013 | Briggs | H05B 33/0815 315/186 |
| 2013/0026933 | A1* | 1/2013 | Gao | H05B 33/0827 315/192 |

OTHER PUBLICATIONS

International Search Report issued Apr. 2, 2013, in PCT/JP13/050238, filed Jan. 9, 2013.
Office Action issued Jan. 14, 2016 in Chinese Patent Application No. 201380014511.2 (with partial English translation).
Office Action mailed Jul. 1, 2016 in Chinese Patent Application No. 201380014511.2 (with English Translation).

* cited by examiner

LED LIGHTING DEVICE

TECHNICAL FIELD

The present invention relates to a light emitting diode (LED) lighting device for lighting a semiconductor light source composed of an LED element.

BACKGROUND ART

LED (Light Emitting Diode) elements as a semiconductor light source are widely used for a vehicle light, a traffic light, and an illumination light. In such purposes, since the light emission amount of a single LED element is small, it is general to light a plurality of LED elements simultaneously, to obtain a required light emission amount.

In a conventional LED lighting device, a converter is connected in series to an LED unit composed of one or a plurality of LED elements connected in series, and further, a single DC power supply is connected to both ends of an LED circuit block composed of the LED unit and the converter. The converter is composed of a switching element, a diode, and a reactor, and constant current control is performed for current flowing in the LED unit by turning on or off the switching element, thereby lighting the LED unit. In addition, a plurality of the LED circuit blocks are connected in parallel to the DC power supply, and the plurality of LED circuit blocks are operated by a single DC power supply (for example, Patent Document 1).

CITATION LIST

Patent Document

Patent Document 1: Japanese Laid-Open Patent Publication No. 2006-147184 (FIG. 1)

SUMMARY OF THE INVENTION

Problems to be Solved by the Invention

In the above conventional LED lighting device, the LED circuit blocks are operated by a single constant voltage source, and the anode side of the diode is connected to a reference potential of the constant voltage source. In this case, particularly, if the series connection number of LED elements composing the LED unit increases, LED voltage which is the sum of forward voltage drops of the LED elements becomes high, and required voltage for lighting the LED unit becomes high. As a result, withstand voltage of each switching element composing the converter becomes high, and further, ripple of reactor current (=LED current) also increases, thereby causing a problem that the circuit scale is enlarged and the cost increases.

The present invention has been made to solve the above problem, and an object of the present invention is to provide an LED lighting device with a small size and low cost that, even in the case where voltage for driving an LED unit is high, can decrease withstand voltage of each switching element composing a converter and decrease ripple of reactor current.

Solution to the Problems

An LED lighting device according to the present invention includes: a first bus having first bus voltage; a second bus having second bus voltage lower than the first bus voltage; an LED circuit block composed of: a series connection body connected to the first bus and formed by a switching element, a reactor, and an LED unit having one or a plurality of LED elements connected in series; and a diode connected between the second bus and a connection point between the switching element and the reactor; and a control circuit for performing ON/OFF control for the switching element so that LED current flowing in the LED unit is within a rated current range. In the case where the LED unit is lit, voltage applied between both ends of series connection of the reactor and the LED unit becomes the first bus voltage, when the switching element is ON, and becomes voltage lower than the first bus voltage, that is determined based on the first bus voltage and the second bus voltage, when the switching element is OFF.

Effect of the Invention

In the LED lighting device of the present invention, the first bus voltage and the second bus voltage are supplied to the LED circuit block, and in the case where the LED unit is lit, voltage applied between both ends of series connection of the reactor and the LED unit becomes the first bus voltage, when the switching element is ON, and becomes voltage lower than the first bus voltage, that is determined based on the first bus voltage and the second bus voltage, when the switching element is OFF. Therefore, a switching element having lower withstand voltage than in the conventional case can be used, and if tolerable ripple of LED current (=reactor current) is the same, the reactor can also be downsized, whereby downsizing and cost reduction of the LED lighting device can be realized.

DESCRIPTION OF EMBODIMENTS

Embodiment 1

Figure 1:
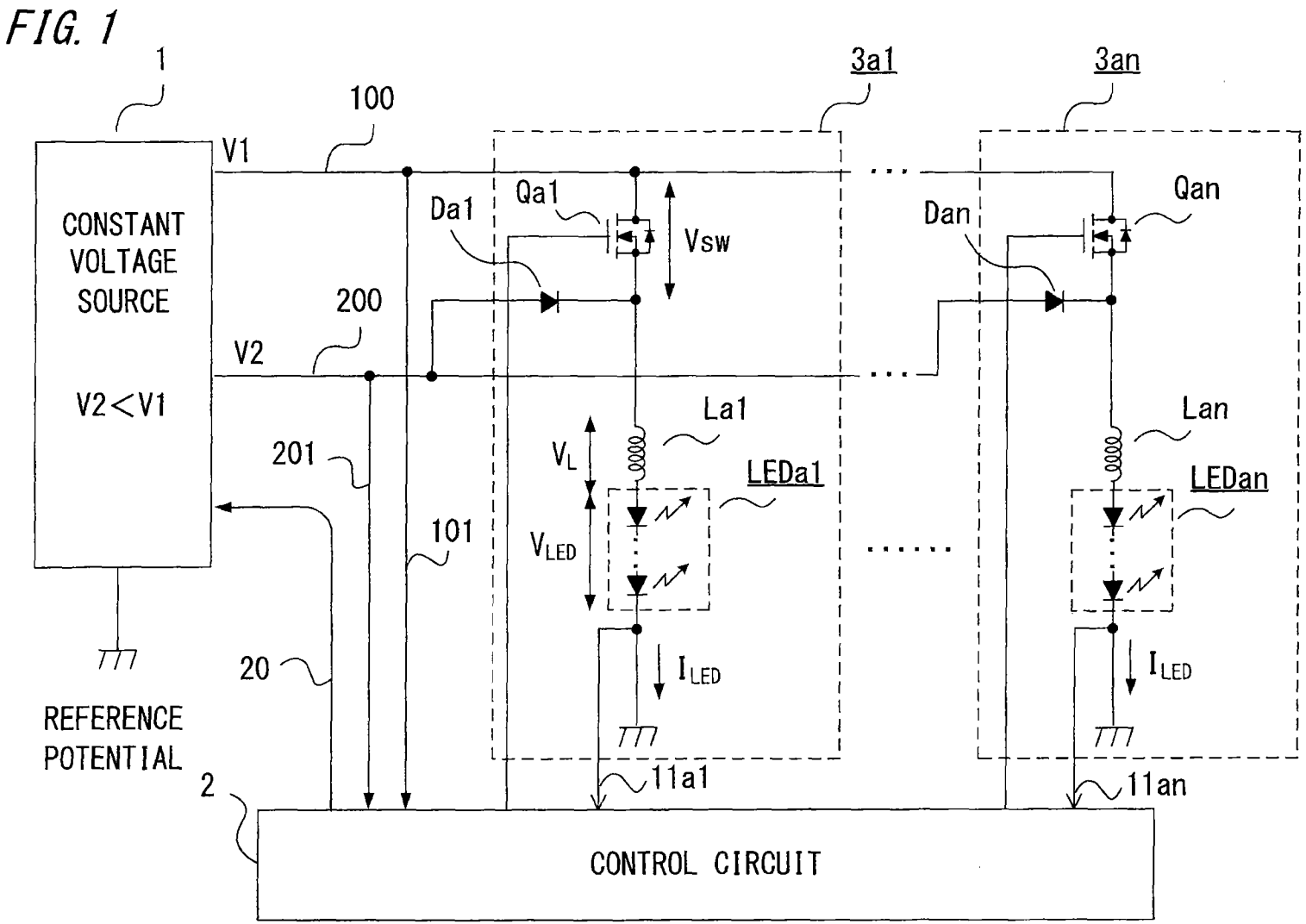
FIG. 1 is a diagram showing the circuit configuration of an LED lighting device according to embodiment 1 of the present invention.
Figure 2:
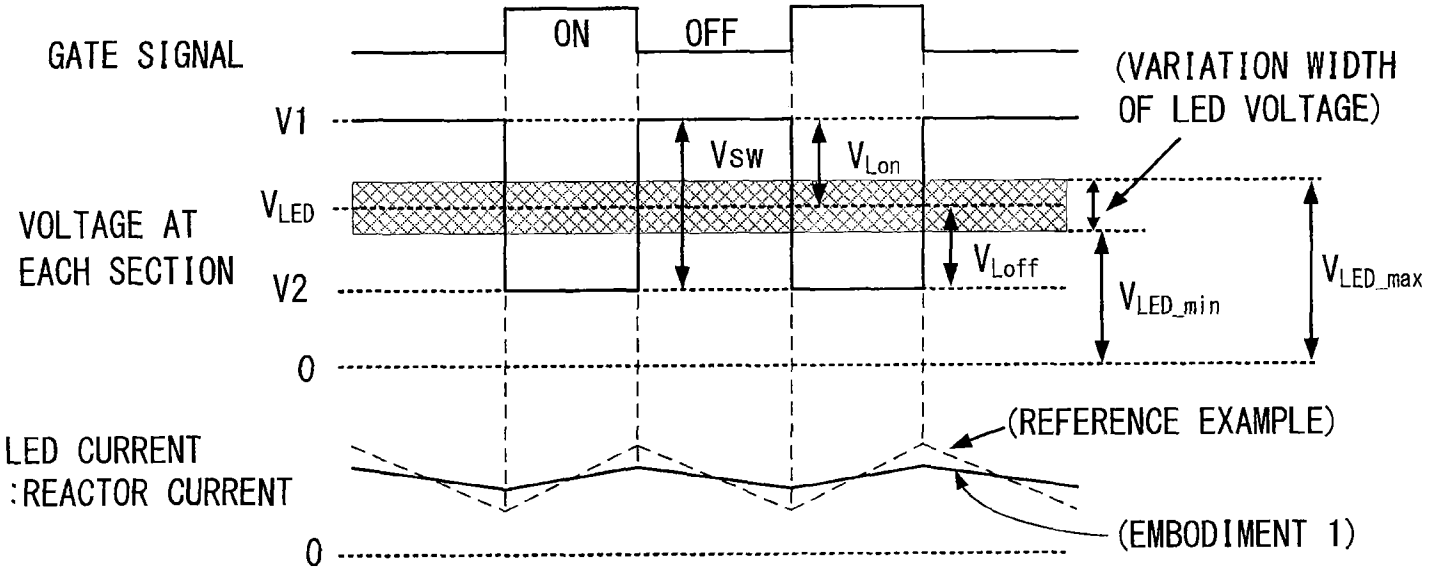
FIG. 2 is a diagram showing a waveform at each section of the LED lighting device according to embodiment 1 of the present invention.

Hereinafter, an LED lighting device according to embodiment 1 of the present invention will be described based on the drawings. FIG. 1 is a circuit configuration diagram showing the LED lighting device according to embodiment 1 of the present invention, and FIG. 2 is a diagram showing a waveform at each section of the LED lighting device of embodiment 1 of the present invention.

In FIG. 1, a constant voltage source 1 outputs DC voltage that is first bus voltage V1 through a first bus 100, and outputs DC voltage that is second bus voltage V2 through a second bus 200, thereby supplying required voltage for lighting an LED element. It is noted that a relationship of first bus voltage V1>second bus voltage V2>0 is satisfied. As a circuit composing the constant voltage source 1, for example, a plurality of DC/DC converters or a switching regulator such as an AC/DC converter can be used.

An LED circuit block 3*a*1 includes a switching element Qa1 such as FET (Field Effect Transistor), a reactor La1, an LED unit LEDa1 composed of one or a plurality of LED elements connected in series, and a diode Da1. In addition, n (n is a natural number equal to or greater than 1) number of LED circuit blocks having the same configuration as the LED circuit block 3*a*1, i.e., the LED circuit blocks 3*a*1 to 3*an* are connected in parallel, to the first bus 100 and the second bus 200.

Next, the detailed configuration of the LED circuit block 3*a*1 will be described. The first bus 100 of the constant voltage source 1 is connected to a first end of the switching element Qa1. On the other hand, a cathode terminal of the diode Da1 and a first end of the reactor La1 are connected to a second end of the switching element Qa1. An anode terminal of the diode Da1 is connected to the second bus 200. A second end of the reactor La1 is connected to an anode side terminal of the LED unit LEDa1 composed of one or a plurality of LED elements connected in series. A cathode side terminal of the LED unit LEDa1 is connected to a reference potential of the constant voltage source 1.

A control circuit 2 detects LED current $I_{LED}$ flowing in each LED unit (LEDa1 to LEDan), and performs ON/OFF control for each switching element (Qa1 to Qan) so that each LED current $I_{LED}$ is within a rated current range, thereby performing constant current control. Detection of LED current $I_{LED}$ can be realized by interposing a shunt resistor between each LED unit (LEDa1 to LEDan) and the reference potential and detecting voltage drop occurring in the shunt resistor when current flows, as disclosed in the above conventional technique, for example. It is noted that in FIG. 1, 11*a*1 to 11*an* indicate detection of each LED current.

In addition, the control circuit 2 detects the first bus voltage V1 and the second bus voltage V2, and performs voltage control for the first bus voltage V1 and the second bus voltage V2 so as to satisfy a condition described later. It is noted that in FIGS. 1, 101 and 201 indicate detections of the first bus voltage V1 and the second bus voltage V2, respectively, and 20 indicates voltage control for the constant voltage source 1 by the control circuit 2. It is noted that, instead of controlling the first bus voltage V1 and the second bus voltage V2 by the control circuit 2, the first bus voltage V1 and the second bus voltage V2 may be set in advance by the constant voltage source 1 so as to satisfy the condition described later.

Next, with reference to FIG. 2, operation of the LED lighting device according to embodiment 1 of the present invention will be described. First, terms used in the operation of the LED lighting device will be described. A "gate signal" is a signal for turning on or off each switching element (Qa1 to Qan), and is outputted from the control circuit 2 to each switching element (Qa1 to Qan). "LED voltage $V_{LED}$" is voltage applied between both ends of each LED unit (LEDa1 to LEDan) when rated current is flown in each LED unit (LEDa1 to LEDan) to light the LED unit. The "LED voltage $V_{LED}$" is the sum of forward voltage drops of the LED elements of each LED unit (LEDa1 to LEDan), and the forward voltage drop varies depending on each LED element. Therefore, the LED voltage $V_{LED}$ also varies depending on each LED unit. A "variation width of LED voltage" corresponds to the difference between a maximum LED voltage $V_{LED_max}$ and a minimum LED voltage $V_{LED_min}$ among the LED units (LEDa1 to LEDan) in use.

Figure 3:
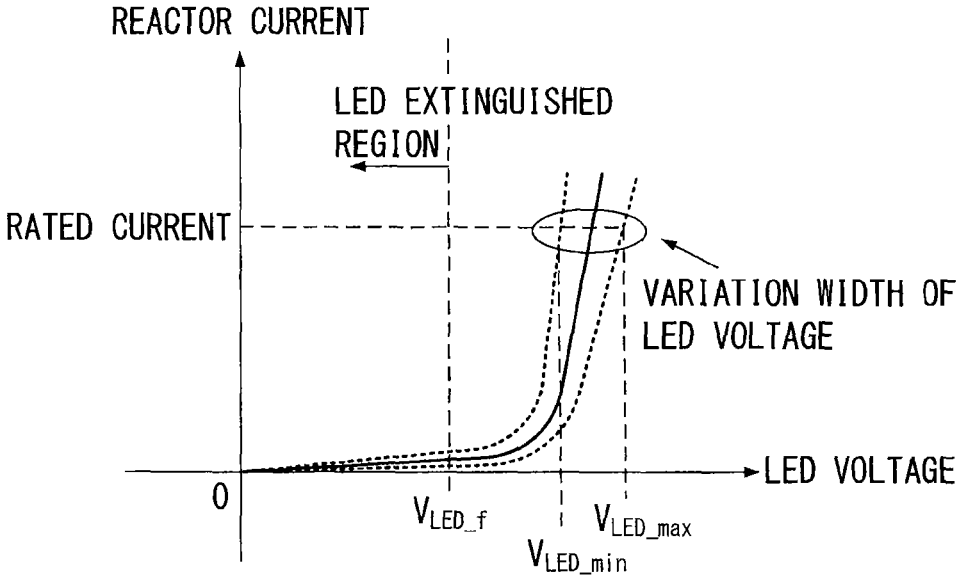
FIG. 3 is a diagram showing static characteristics of LED units composing LED lighting devices according to embodiments 1 to 6 of the present invention.

In addition, although not shown in FIG. 2, LED voltage when current is small enough that the LED units (LEDa1 to LEDan) are substantially regarded as being extinguished is denoted by $V_{LED_f}$. The relationship among $V_{LED_max}$, $V_{LED_min}$, and $V_{LED_f}$, when represented by static characteristics of LEDs, is as shown in FIG. 3.

Next, concrete operation of the LED lighting device will be described in order.

The LED lighting device according to embodiment 1 of the present invention has a feature that the range of the first bus voltage V1, the second bus voltage V2, or the LED voltage $V_{LED}$ is set such that, when each LED unit (LEDa1 to LEDan) is lit, the first bus voltage V1, the second bus voltage V2, and the LED voltage $V_{LED}$ satisfy the following relationship.

$$V2<V_{LED_min} \text{ and } V_{LED_max}<V1 \quad (1)$$

By thus setting them, the LED lighting device operates as described below. It is noted that operations of the LED circuit blocks (3*a*1 to 3*an*) are basically the same, so the LED circuit block 3*a*1 will be described here as an example.

First, when the control circuit 2 turns on the gate signal for the switching element Qa1, the switching element Qa1 is turned on, so that energy is supplied from the constant voltage source 1 to the LED circuit block 3*a*1. At this time, both-end voltage Vsw of the switching element Qa1 becomes zero, and voltage of [V1−V2] is applied as reverse voltage between both ends of the diode Da1. In addition, voltage of [$V_{Lon}$=V1−$V_{LED}$] is applied between both ends of the reactor La1, whereby LED current (=reactor current) gradually increases. Then, the LED voltage $V_{LED}$ is applied between both ends of the LED unit LEDa1, whereby the LED unit LEDa1 is lit. During a period in which the switching element Qa1 is ON, energy is stored in the reactor La1. The energy stored in the reactor La1 is used as energy for maintaining the LED current within the rated current range during a period in which the switching element Qa1 is off.

When the LED current has increased and reached the upper limit of the rated current, the control circuit 2 turns off the gate signal for the switching element Qa1, whereby the switching element Qa1 is turned off. As a result, the first bus voltage V1 is applied to the first end of the switching element Qa1, and meanwhile, as the diode Da1 is turned on, the second bus voltage V2 is applied to the second end side of the switching element Qa1. Therefore, the both-end voltage Vow of the switching element Qa1 becomes [VSW=V1−V2]. In addition, between both ends of the reactor La1, voltage of [$V_{Loff}$=$V_{LED}$−V2] is applied in a direction opposite to the previous direction. That is, between both ends of the reactor La1, voltage of [$V_L$=$V_{Lon}$+$V_{Loff}$=V1−V2] is applied in accordance with ON and OFF of the switching element Qa1. Then, LED current continues to flow in the LED unit LEDa1, and LED voltage $V_{LED}$ continues to be applied between both ends thereof, whereby the LED unit LEDa1 is lit.

As energy stored in the reactor La1 decreases, when the LED current has decreased and reached the lower limit of the rated current, the control circuit 2 turns on the gate signal for the switching element Qa1 again, thereby turning on the switching element Qa1. Hereafter, the series of operations described above is repeated, so that LED voltage $V_{LED}$ is always applied between both ends of the LED unit LEDa1 and LED current within the rated current range continues to flow, whereby lighting of the LED unit LEDa1 is maintained. The other LED circuit blocks also perform the same operation.

Figure 4:
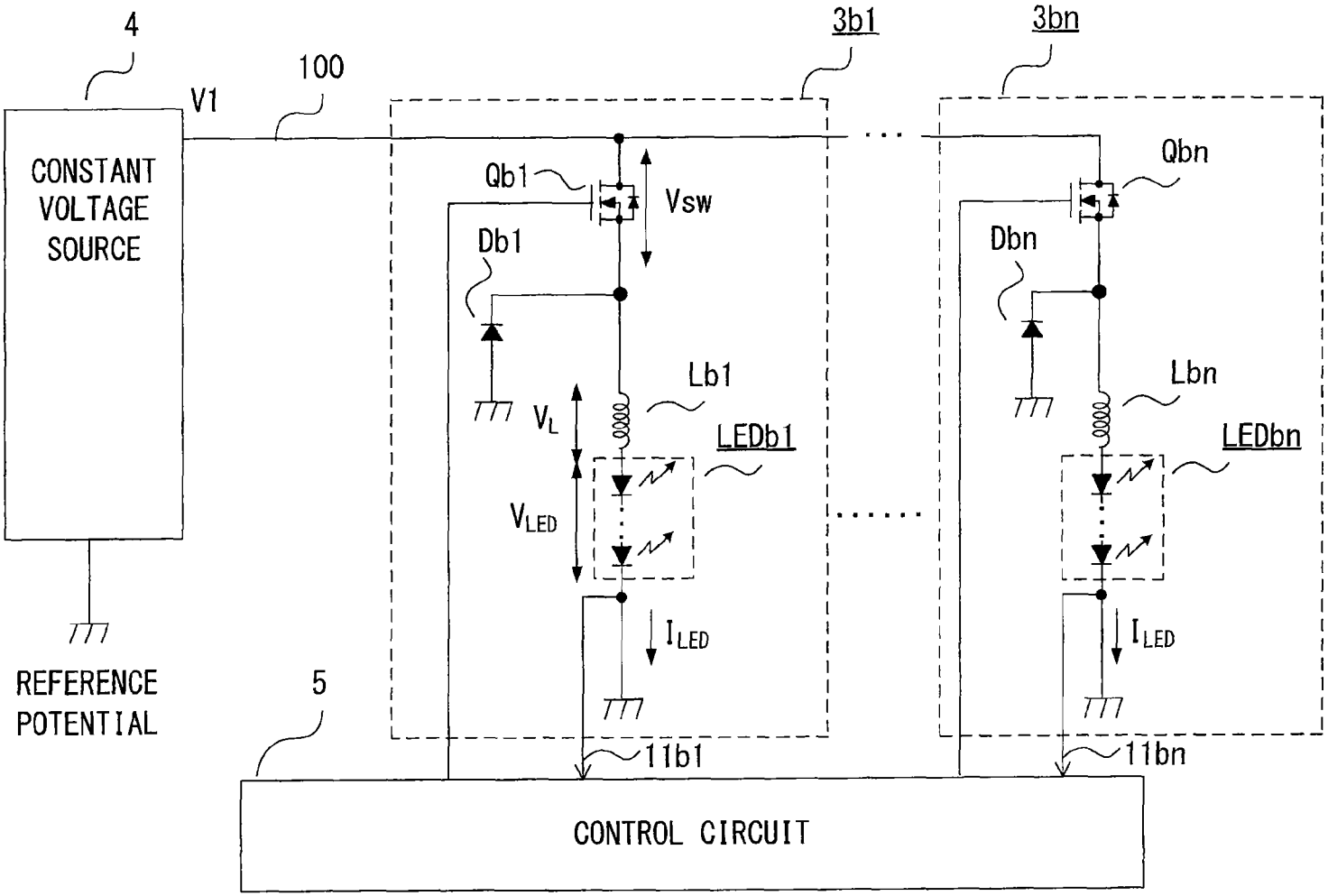
FIG. 4 is a diagram showing the circuit configuration of an LED lighting device of a reference example of the present invention.
Figure 5:
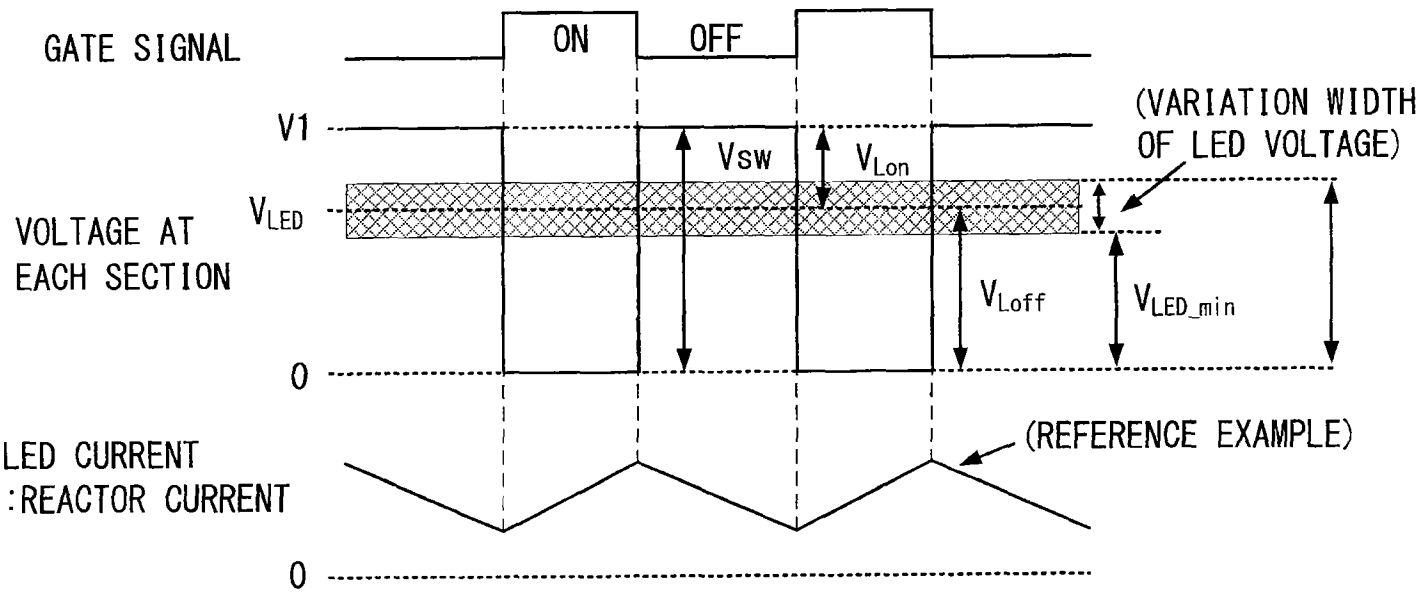
FIG. 5 is a diagram showing a waveform at each section of the LED lighting device of the reference example of the present invention.

Next, the operation effect of the LED lighting device according to embodiment 1 will be described in comparison with an LED lighting device of a reference example shown in FIGS. 4 and 5. FIG. 4 is a circuit configuration diagram showing the LED lighting device according to the reference example, and FIG. 5 is a diagram showing a waveform at each section of the LED lighting device of the reference example in FIG. 4. It is noted that in FIGS. 4 and 5, composing elements having common functions with those in FIGS. 1 and 2 are denoted by the same symbols, or only suffixes are changed for such elements.

The configuration of the LED lighting device of the reference example is different from the LED lighting device according to embodiment 1 in the following two points. The first point is that a constant voltage source 4 of the LED lighting device of the reference example outputs only one kind of voltage, i.e., the first bus voltage V1, and the second point is that anode terminals of diodes (Db1 to Dbn) of the LED lighting device of the reference example are connected to a reference potential of the constant voltage source 4. A control circuit 5 detects LED current flowing in an LED unit LEDb1 and performs ON/OFF control for a switching element Qb1 so that the LED current is within a rated current range, thereby performing constant current control. In such an LED lighting device of the reference example, when the above-described constant current control is performed and thereby each LED unit (LEDb1 to LEDbn) is lit, both-end voltage of each LED unit (LEDb1 to LEDbn) becomes LED voltage $V_{LED}$, and this is the same as in embodiment 1, but the first bus voltage V1 is applied between both ends of each switching element (Qb1 to Qbn) and between both ends of each reactor (Lb1 to Lbn).

On the other hand, as described above, the LED lighting device according to embodiment 1 of the present invention can reduce both-end voltages of the switching elements (Qa1 to Qan) and the reactors (La1 to Lan) by the amount due to the second bus voltage V2, as compared to the case of the LED lighting device of the reference example.

As described above, the LED lighting device according to embodiment 1 of the present invention sets the range of the first bus voltage V1, second bus voltage V2, or the LED voltage $V_{LED}$ such that, when each LED unit (LEDa1 to LEDan) is lit, the first bus voltage V1, the second bus voltage V2, and the LED voltage $V_{LED}$ satisfy the following relationship.

$$V2<V_{LED_min} \text{ and } V_{LED_max}<V1 \quad (1)$$

Thus, it becomes possible to reduce voltages applied to the switching element and the reactor, as compared to the case of conventional LED lighting devices including the reference example. Therefore, a switching element having lower withstand voltage than those in conventional devices including the reference example can be used, and if tolerable ripple of LED current (=reactor current) is the same, the reactor can also be downsized, whereby an LED lighting device with a small size and low cost can be provided.

In addition, in the LED lighting device according to embodiment 1 of the present invention, in the case of extinguishing the LED units (LEDa1 to LEDan), the switching elements (Qa1 to Qan) may be turned off, and further, the second bus voltage V2 may be set as V2≤$V_{LED_f}$.

Further, in ON/OFF control for the switching elements (Qa1 to Qan) by the control circuit 2, as described above, an upper limit and a lower limit may be set for the LED current, and each switching element (Qa1 to Qan) may be turned on or off every time the LED current reaches the upper limit or the lower limit, or instead, the duty (=ON time/ON-OFF period) of each switching element (Qa1 to Qan) may be controlled so that the average value of the LED current becomes predetermined current. In addition, for each LED unit (LEDa1 to LEDan), a capacitor may be interposed in parallel, whereby ripple of current flowing in each LED unit (LEDa1 to LEDan) may be reduced.

Embodiment 2

Figure 6:
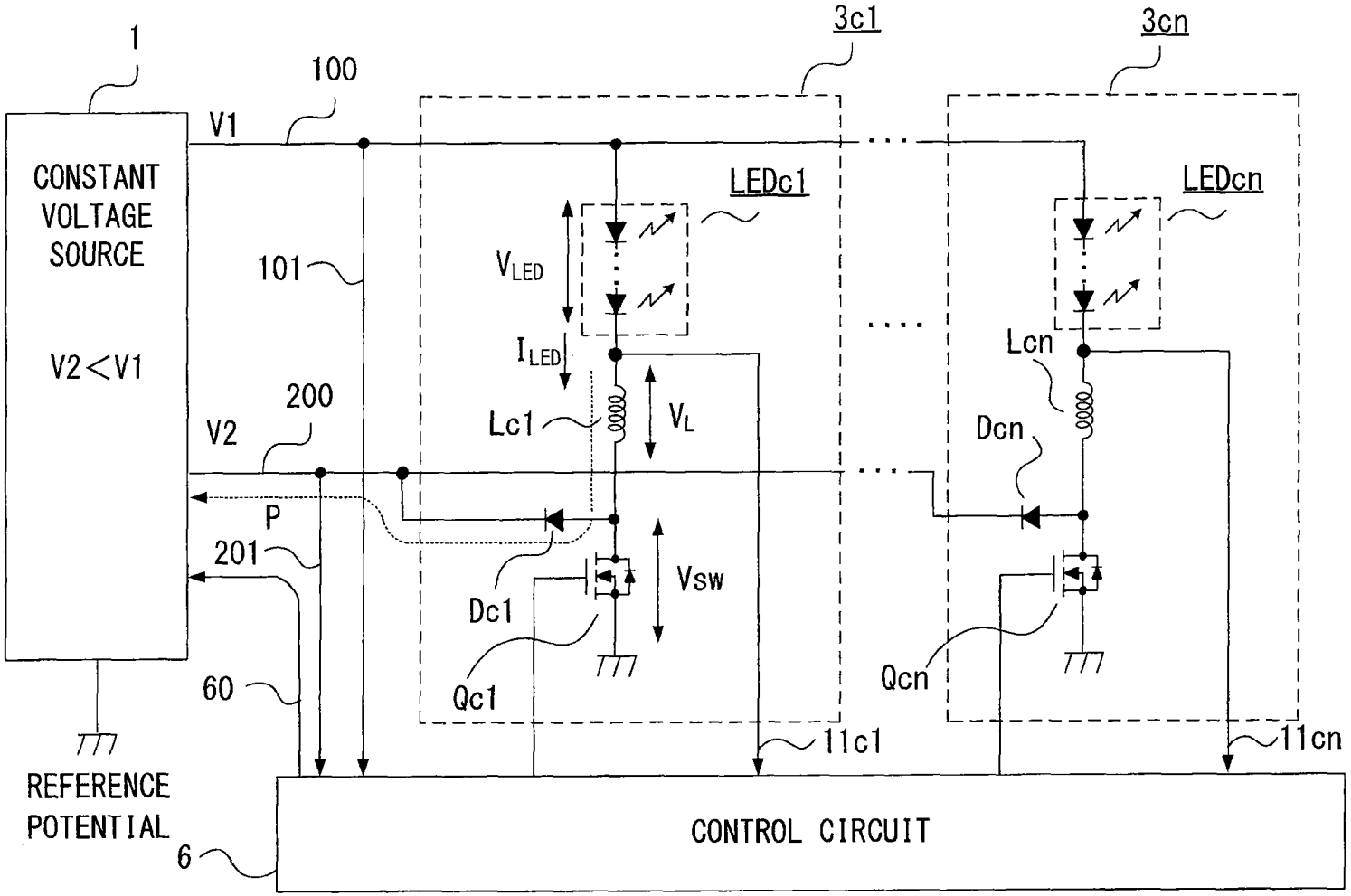
FIG. 6 is a diagram showing the circuit configuration of an LED lighting device according to embodiment 2 of the present invention.
Figure 7:
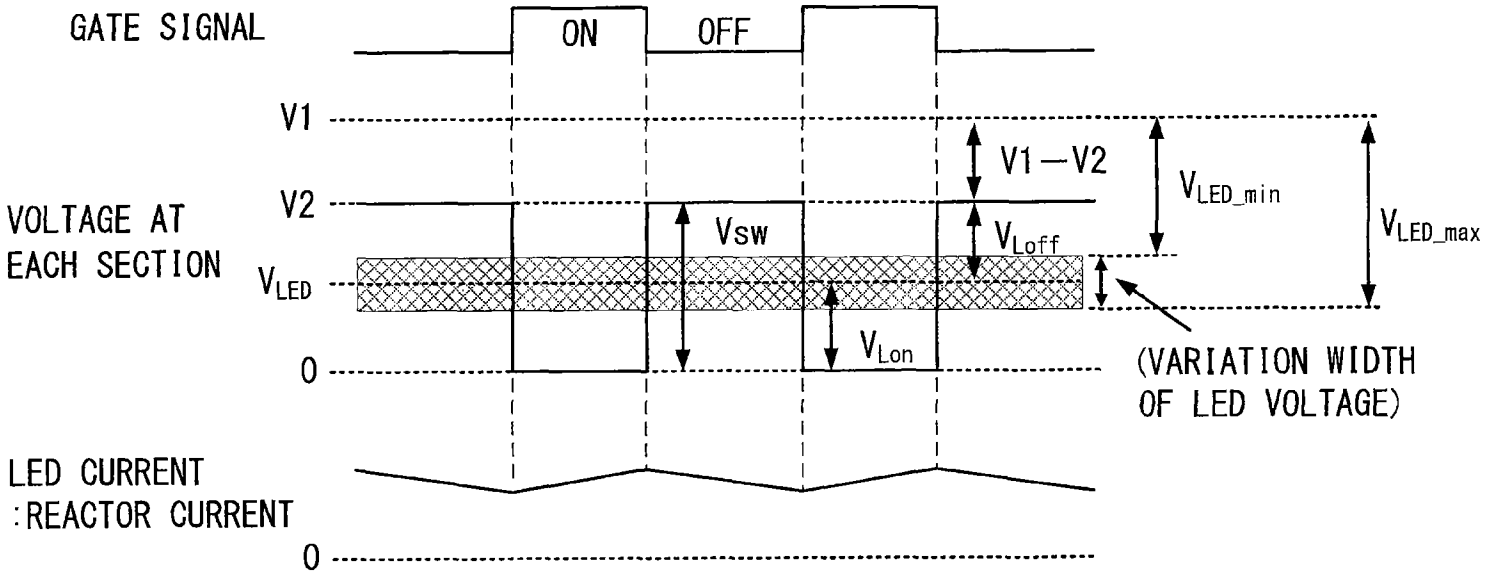
FIG. 7 is a diagram showing a waveform at each section of the LED lighting device according to embodiment 2 of the present invention.

Next, an LED lighting device according to embodiment 2 of the present invention will be described based on the drawings. FIG. 6 is a diagram showing the circuit configuration of the LED lighting device according to embodiment 2 of the present invention. FIG. 7 is a diagram showing a waveform at each section of the LED lighting device of embodiment 2 of the present invention.

In the circuit configuration of the LED lighting device in FIG. 6, composing elements having common functions with those in embodiment 1 (FIG. 1) are denoted by the same symbols, or only suffixes are changed for such elements. In embodiment 2, the connection orders of elements composing LED circuit blocks (3*c*1 to 3*cn*) and the polarities of diodes (Dc1 to Dcn) are different from those in the circuit configuration of embodiment 1. Since the configurations of the LED circuit blocks (3*c*1 to 3*cn*) are the same, connection of the composing elements will be described about the LED circuit block 3*c*1 as an example.

First, as in embodiment 1, the constant voltage source 1 outputs DC voltage that is first bus voltage V1 through the first bus 100, and outputs DC voltage that is second bus voltage V2 through the second bus voltage 200, thereby supplying required voltage for lighting an LED element. It is noted that a relationship of first bus voltage V1>second bus voltage V2>0 is satisfied. The first bus 100 is connected to an anode side terminal of an LED unit LEDc1. In addition, a cathode side terminal of the LED unit LEDc1 is connected to a first end of a reactor Lc1, and a second end of the reactor Lc1 is connected to a first end of a switching element Qc1. Further, a second end of the switching element Qc1 is connected to the reference potential of the constant voltage source 1. In addition, an anode terminal of the diode Dc1 is connected to a connection point between the reactor Lc1 and the switching element Qc1, and a cathode terminal of the diode Dc1 is connected to the second bus 200. The second bus 200 allows suck of current.

A control circuit 6 detects LED current $I_{LED}$ flowing in each LED unit (LEDc1 to LEDcn) and performs ON/OFF control for each switching element (Qc1 to Qcn) so that each LED current $I_{LED}$ is within a rated current range, thereby performing constant current control. Detection of LED current is performed on the anode side or the cathode side of each LED unit (LEDc1 to LEDcn), and for example, an amplifier or the like adapted for current detection on the high-voltage side can be used. It is noted that in FIG. 6, 11*c*1 to 11*cn* indicate detection of each LED current.

In addition, the control circuit 2 detects the first bus voltage V1 and the second bus voltage V2, and performs voltage control for the first bus voltage V1 and the second bus voltage V2 so as to satisfy a condition described later. It is noted that in FIGS. 6, 101 and 201 indicate detections of the first bus voltage V1 and the second bus voltage V2, respectively, and 60 indicates voltage control for the constant voltage source 1 by the control circuit 6. It is noted that, instead of controlling the first bus voltage V1 and the second bus voltage V2 by the control circuit 2, the first bus voltage V1 and the second bus voltage V2 may be set in advance by the constant voltage source 1 so as to satisfy the condition described later.

Next, with reference to FIG. 7, concrete operation of the LED lighting device according to embodiment 2 of the present invention will be described in order.

The LED lighting device according to embodiment 2 of the present invention has a feature that the range of the first bus voltage V1, the second bus voltage V2, or the LED voltage $V_{LED}$ is set such that, when each LED unit (LEDc1 to LEDcn) is lit, the first bus voltage V1, the second bus voltage V2, and the above-described LED voltage $V_{LED}$ satisfy the following relationship.

$$V1-V2<V_{LED_min} \text{ and } V_{LED_max}<V1 \quad (2)$$

By thus setting them, the LED lighting device operates as described below. It is noted that operations of the LED circuit blocks (3*c*1 to 3*cn*) are basically the same, so the LED circuit block 3*c*1 will be described here as an example.

First, when the control circuit 6 turns on the gate signal for the switching element Qc1, the switching element Qc1 is turned on, so that energy is supplied from the constant voltage source 1 to the LED circuit block 3*c*1. At this time, both-end voltage Vsw of the switching element Qc1 becomes zero, and the second bus voltage V2 is applied as reverse voltage between both ends of the diode Dc1. In addition, voltage of [$V_{Lon}$=V1−$V_{LED}$] is applied between both ends of the reactor Lc1, whereby LED current (=reactor current) gradually increases. Then, the LED voltage $V_{LED}$ is applied to the LED unit LEDc1, whereby the LED unit LEDc1 is lit. During a period in which the switching element Qc1 is ON, energy is stored in the reactor Lc1. The energy stored in the reactor Lc1 is used as an energy source for maintaining the LED current within the rated current range during a period in which the switching element Qc1 is off.

When the LED current has increased and reached the upper limit of the rated current, the control circuit 6 turns off the gate signal for the switching element Qc1, whereby the switching element Qc1 is turned off. As a result, the both-end voltage Vsw of the switching element Qc1 becomes the second bus voltage V2. In addition, between both ends of the reactor Lc1, voltage of [$V_{Loff}$=$V_{LED}$−(V1−V2)] is applied in a direction opposite to the previous direction. That is, between both ends of the reactor Lc1, voltage of [$V_L$=$V_{Lon}$+$V_{Loff}$=V2] is applied in accordance with ON and OFF of the switching element Qc1. Then, LED current continues to flow in the LED unit LEDc1, and LED voltage $V_{LED}$ continues to be applied between both ends thereof, whereby the LED unit LEDc1 is lit. Further, a current route at this time is as shown by a broken-line arrow P, and energy is regenerated to the constant voltage source 1.

As energy stored in the reactor Lc1 decreases, when the LED current has decreased and reached the lower limit of the rated current, the control circuit 6 turns on the gate signal for the switching element Qc1 again, thereby turning on the switching element Qc1. Hereafter, the series of operations described above is repeated, so that LED voltage $V_{LED}$ is always applied between both ends of the LED unit LEDc1 and LED current within the rated current range continues to flow, whereby lighting of the LED unit LEDc1 is maintained. The other LED circuit blocks also perform the same operation.

As described above, the LED lighting device according to embodiment 2 of the present invention sets the range of the first bus voltage V1, second bus voltage V2, or the LED voltage $V_{LED}$ such that, when each LED unit (LEDc1 to LEDcn) is lit, the first bus voltage V1, the second bus voltage V2, and the LED voltage $V_{LED}$ satisfy the following relationship.

$$V1-V2<V_{LED_min} \text{ and } V_{LED_max}<V1 \quad (2)$$

Thus, it becomes possible to reduce voltages applied to the switching element and the reactor to the second bus voltage V2 (<V1), as compared to the case of the LED lighting device of the reference example described in FIGS. 4 and 5. Therefore, a switching element having lower withstand voltage than those in conventional devices including the reference example in FIGS. 4 and 5 can be used, and if tolerable ripple of LED current (=reactor current) is the same, the reactor can also be downsized, whereby an LED lighting device with a small size and low cost can be provided. In addition, since energy is regenerated during a period in which each switching element (Qc1 to Qcn) is off, an LED lighting device with higher efficiency than in conventional case can be provided.

In addition, in the LED lighting device according to embodiment 2, in the case of extinguishing the LED units (LEDc1 to LEDcn), the switching elements (Qc1 to Qcn) may be turned off, and further, the first bus voltage V1 or the second bus voltage V2 may be set so as to satisfy [V1−V2≤$V_{LED_f}$].

Further, in control for the switching elements (Qc1 to Qcn) by the control circuit 6, as described above, an upper limit and a lower limit may be set for the LED current, and each switching element (Qc1 to Qcn) may be turned on or off every time the LED current reaches the upper limit or the lower limit, or instead, the duty (=ON time/ON-OFF period) of each switching element (Qc1 to Qcn) may be controlled so that the average value of the LED current becomes predetermined current. In addition, for each LED unit (LEDc1 to LEDcn), a capacitor may be interposed in parallel, whereby ripple of current flowing in each LED unit (LEDc1 to LEDcn) may be reduced.

Embodiment 3

Figure 8:
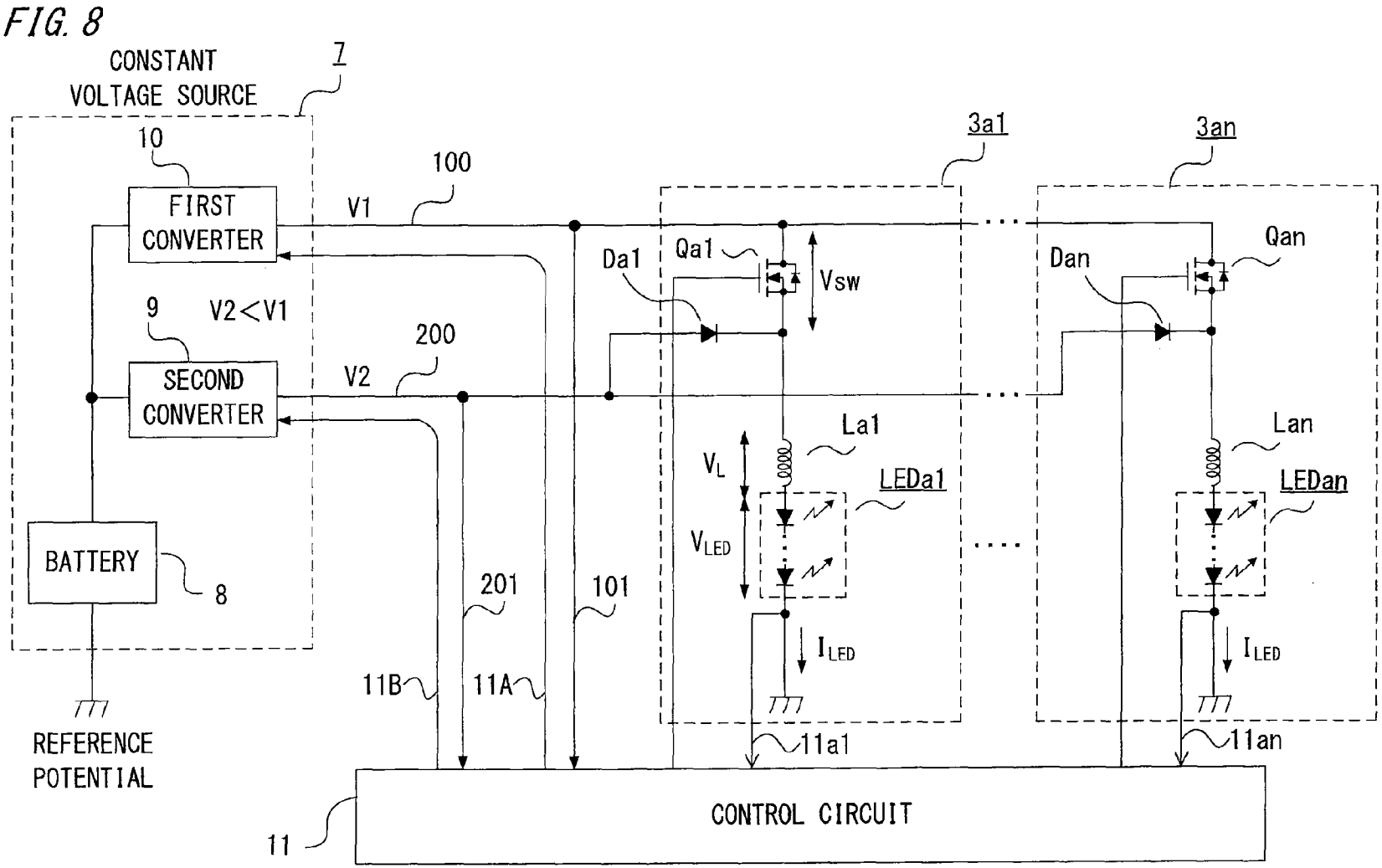
FIG. 8 is a diagram showing the circuit configuration of an LED lighting device according to embodiment 3 of the present invention.

Next, an LED lighting device according to embodiment 3 of the present invention will be described based on the drawings. FIG. 8 is a circuit configuration diagram of the LED lighting device according to embodiment 3 of the present invention. In FIG. 8, composing elements having common functions with those in embodiment 1 (FIG. 1) are denoted by the same symbols, or only suffixes are changed for such elements.

The LED lighting device according to embodiment 3 assumes use in a vehicle, and is composed of a constant voltage source 7, the LED circuit blocks (3*a*1 to 3*an*) described in embodiment 1, and a control circuit 11. The basic configurations of these components are the same as in the LED lighting device according to embodiment 1, and the constant voltage source 7 corresponds to the constant voltage source 1 of embodiment 1 with its configuration specified. In addition, the control circuit 11 is obtained by adding a function of controlling converters composing the constant voltage source 7 to the function of the control circuit 2 of embodiment 1. Therefore, the voltage conditions for lighting and extinguishing each LED unit (LEDa1 to LEDan) of the LED lighting device according to embodiment 3, and a waveform at each section during operation thereof are the same as in the LED lighting device according to embodiment 1. Therefore, the description of their operations is omitted, and the configuration of the constant voltage source 7 and the function of the control circuit 11 will be described.

Since the LED lighting device according to embodiment 3 of the present invention assumes use in a vehicle, it is necessary to generate, from battery voltage VB outputted from a battery 8, the first bus voltage V1 and the second bus voltage V2 having the following voltage relationship described in the LED lighting device of embodiment 1.

$$V2<V_{LED_min} \text{ and } V_{LED_max}<V1 \quad (1)$$

Here, if the series connection number of LED elements composing each LED unit (LEDa1 to LEDan) is large and [battery voltage VB<LED voltage $V_{LED_max}$] is satisfied, each LED unit (LEDa1 to LEDan) cannot be lit. Therefore, a first converter 10 is provided on the output side of the battery 8, thereby stepping up the battery voltage VB and providing the first bus voltage V1 that is higher than $V_{LED_max}$. In the case where the battery voltage VB is higher than the LED voltage $V_{LED_max}$, the first converter 10 may perform step-down operation or the first converter 10 itself may be omitted. In addition, the second bus voltage V2 is generated by a second converter 9 provided between the anode terminals of the diodes (Da1 to Dan) and an output terminal of the battery 8. Here, the second converter 9 receives an input from the battery voltage VB side and allows flow-out of current to the second bus 200 side.

The control circuit 11 detects voltages of the first bus voltage V1 and the second bus voltage V2, and controls the first converter 10 and the second converter 9 so that these voltages satisfy the voltage condition of embodiment 1. It is noted that in FIG. 8, 11A indicates voltage control for the first converter 10 by the control circuit 11, and 11B indicates voltage control for the second converter 9 by the control circuit 11. In addition, the control circuit 11 also performs the constant current control for LED current described in embodiment 1. It is noted that as voltage detection means for the first bus voltage V1 and the second bus voltage V2, a voltage dividing resistor connected between each output terminal and reference voltage can be used, for example. In addition, as the first converter 10 and the second converter 9, a switching regulator can be used, for example.

As described above, according to embodiment 3 of the present invention, the constant voltage source has the battery, the first converter, and the second converter, and the control circuit performs control so that output of the first converter becomes the first bus voltage V1 and output of the second converter becomes the second bus voltage V2. Therefore, particularly, for use in a vehicle, the same effect as in the LED lighting device of embodiment 1 can be obtained.

Embodiment 4

Figure 9:
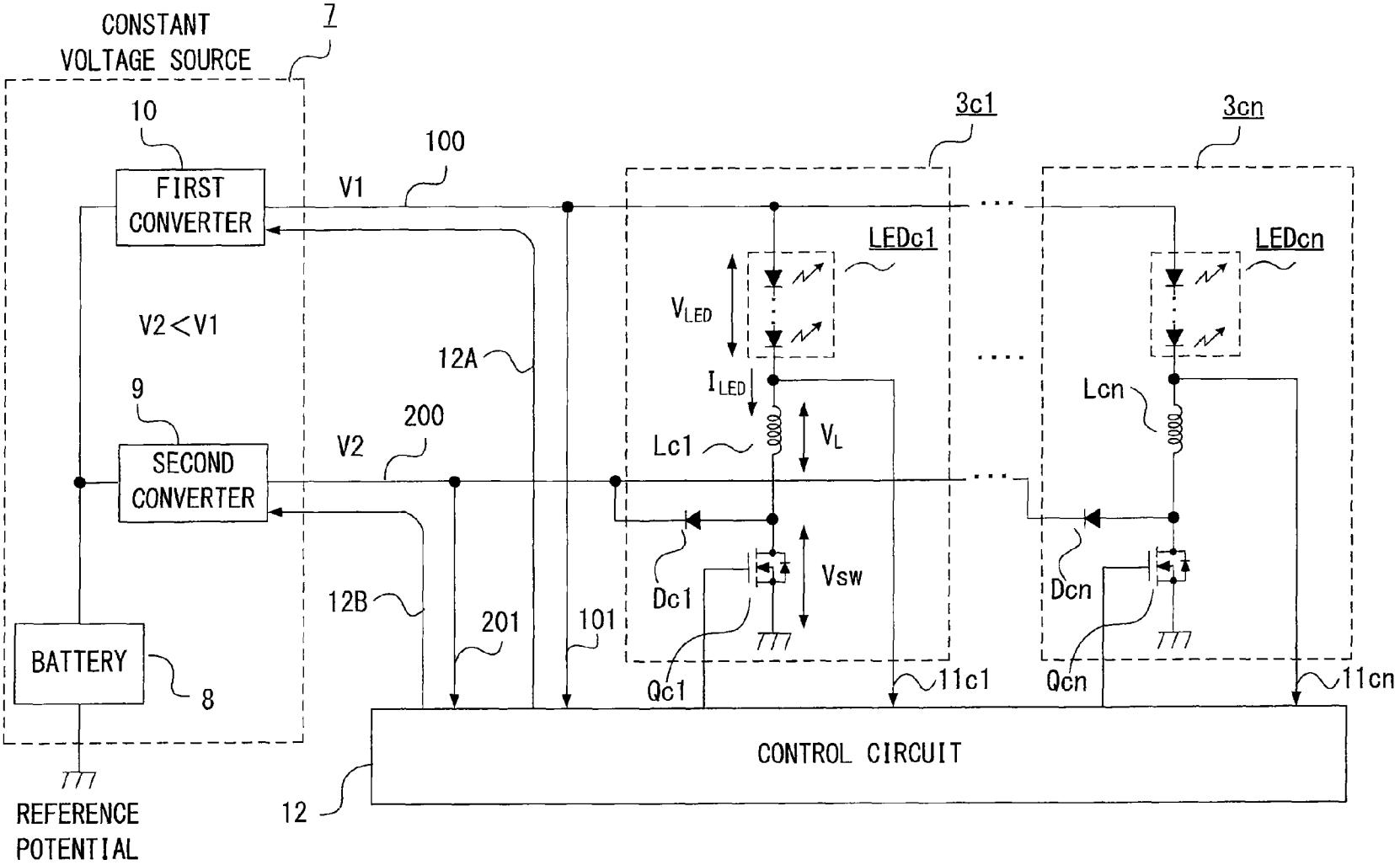
FIG. 9 is a diagram showing the circuit configuration of an LED lighting device according to embodiment 4 of the present invention.

Next, an LED lighting device according to embodiment 4 of the present invention will be described based on the drawings. FIG. 9 is a circuit configuration diagram of the LED lighting device according to embodiment 4 of the present invention. In FIG. 9, composing elements having common functions with those in the above embodiments are denoted by the same symbols, or only suffixes are changed for such elements.

The LED lighting device according to embodiment 4 assumes use in a vehicle, and is composed of the constant voltage source 7, the LED circuit blocks (3*c*1 to 3*cn*) described in embodiment 2, and a control circuit 12. The basic configurations of these components are the same as in the LED lighting device according to embodiment 2, and the constant voltage source 7 corresponds to the constant voltage source 1 of embodiment 2 with its configuration specified. In addition, the control circuit 12 is obtained by adding a function of controlling converters composing the constant voltage source 7 to the function of the control circuit 6 of embodiment 2. Therefore, the voltage conditions for lighting and extinguishing each LED unit (LEDc1 to LEDcn) of the LED lighting device according to embodiment 4, and a waveform at each section during operation thereof are the same as in the LED lighting device according to embodiment 2. Therefore, the description of their operations is omitted, and the functions of the constant voltage source 7 and the control circuit 12 will be described.

Since the LED lighting device according to embodiment 4 of the present invention assumes use in a vehicle, it is necessary to generate, from battery voltage VB outputted from the battery 8, the first bus voltage V1 and the second bus voltage V2 having the following voltage relationship described in the LED lighting device of embodiment 2.

$$V1-V2<V_{LED_min} \text{ and } V_{LED_max}<V1 \quad (2)$$

Here, if the series connection number of LED elements composing each LED unit (LEDc1 to LEDcn) is large and [battery voltage VB<LED voltage $V_{LED_max}$] is satisfied, each LED unit (LEDc1 to LEDcn) cannot be lit. Therefore, the first converter 10 is provided on the output side of the battery 8, thereby stepping up the battery voltage VB and providing the first bus voltage V1 that is higher than $V_{LED_max}$. In the case where the battery voltage VB is higher than the LED voltage $V_{LED_max}$, the first converter 10 may perform step-down operation or the first converter 10 itself may be omitted. In addition, the second bus voltage V2 is generated by the second converter 9 provided between the cathode terminals of the diodes (Dc1 to Dcn) and the output terminal of the battery 8. Here, the second converter 9 receives an input from the second bus 200 side and outputs the battery voltage VB, and allows suck of current from the second bus 200 side.

As described above, the LED lighting device according to embodiment 4 of the present invention includes, as the constant voltage source, the battery, the first converter, and the second converter which are connected to the output terminal of the battery. And the control circuit performs control so that output of the first converter becomes the first bus voltage V1 and output of the second converter becomes the second bus voltage V2. Therefore, particularly, for use in a vehicle, the same effect as in the LED lighting device of embodiment 2 can be obtained.

Embodiment 5

Figure 10:
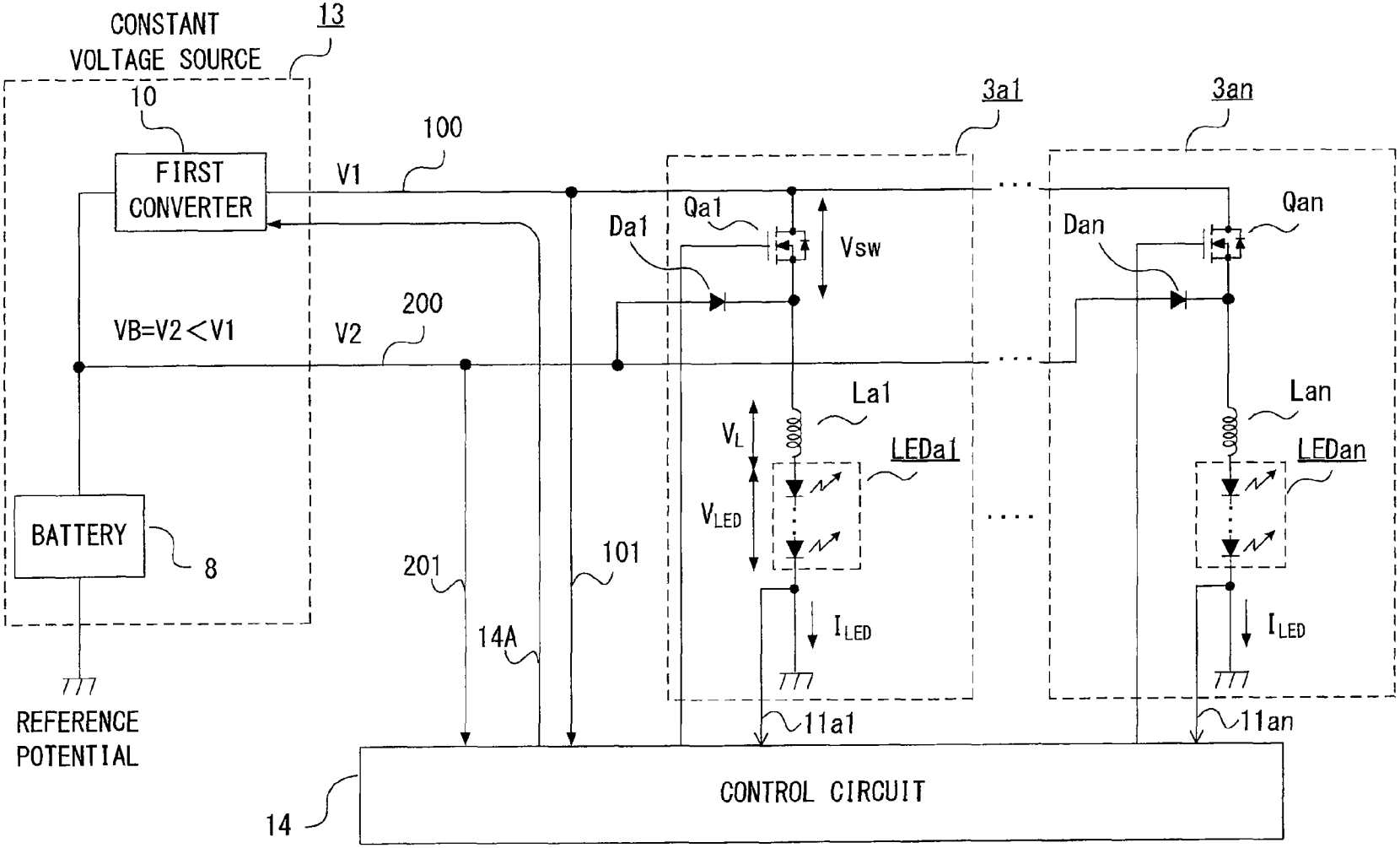
FIG. 10 is a diagram showing the circuit configuration of an LED lighting device according to embodiment 5 of the present invention.

Next, an LED lighting device according to embodiment 5 of the present invention will be described based on the drawings. FIG. 10 is a circuit configuration diagram of the LED lighting device according to embodiment 5 of the present invention. The circuit configuration of embodiment 5 shown in FIG. 10 corresponds to the LED lighting device of embodiment 3 shown in FIG. 8 from which the second converter 9 is removed. A control circuit 14 only performs control for the first bus voltage V1 and constant current control. The circuit operation in FIG. 10 is the same as in embodiment 3, so the description thereof is omitted.

In the LED lighting device according to embodiment 5 of the present invention, since the second bus voltage V2 is fixed at the battery voltage VB, the effect of reducing withstand voltages of composing elements, obtained in this case is not as large as in the LED lighting device of embodiment 3. However, since the second converter 9 is removed and the function of controlling the second converter 9 is removed from the control circuit 14, circuitry downsizing and simplification of the control circuit can be realized more than in embodiment 3.

Embodiment 6

Figure 11:
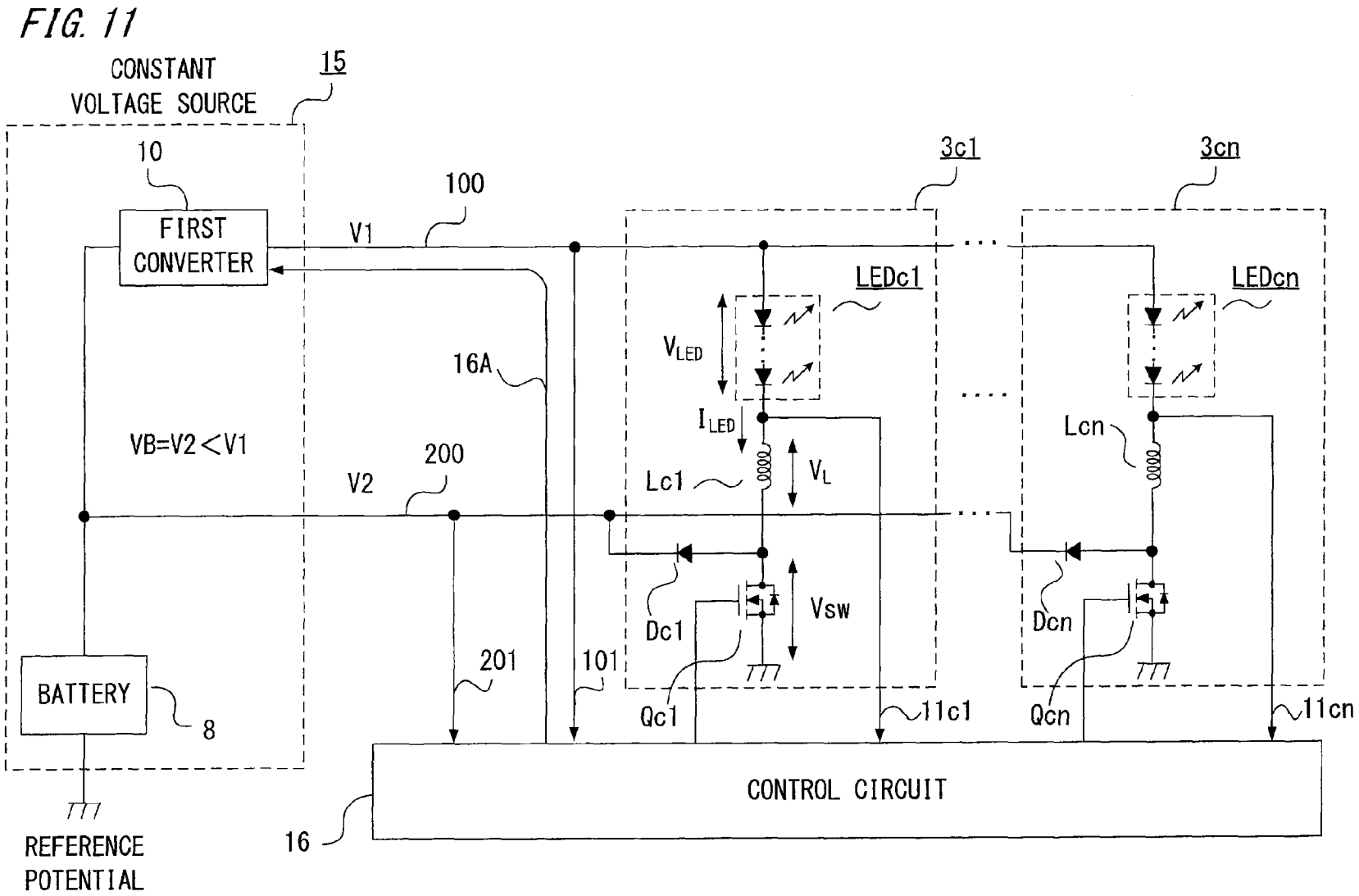
FIG. 11 is a diagram showing the circuit configuration of an LED lighting device according to embodiment 6 of the present invention.

Next, an LED lighting device according to embodiment 6 of the present invention will be described based on the drawings. FIG. 11 is a circuit configuration diagram of the LED lighting device according to embodiment 6 of the present invention. The circuit configuration of embodiment 6 shown in FIG. 11 corresponds to the LED lighting device of embodiment 4 shown in FIG. 9 from which the second converter 9 is removed. Along with this, a control circuit 16 only performs control for the first bus voltage V1 and constant current control. The circuit operation in FIG. 11 is the same as in embodiment 4, so the description thereof is omitted.

In the LED lighting device according to embodiment 6 of the present invention, since the second bus voltage V2 is fixed at the battery voltage VB, the effect of reducing withstand voltages of composing elements, obtained in this case is not as large as in the LED lighting device of embodiment 4. However, since the second converter 9 is removed and the function of controlling the second converter 9 is removed from the control circuit 14, circuitry downsizing and simplification of the control circuit can be realized more than in embodiment 4.

Embodiment 7

Figure 12:
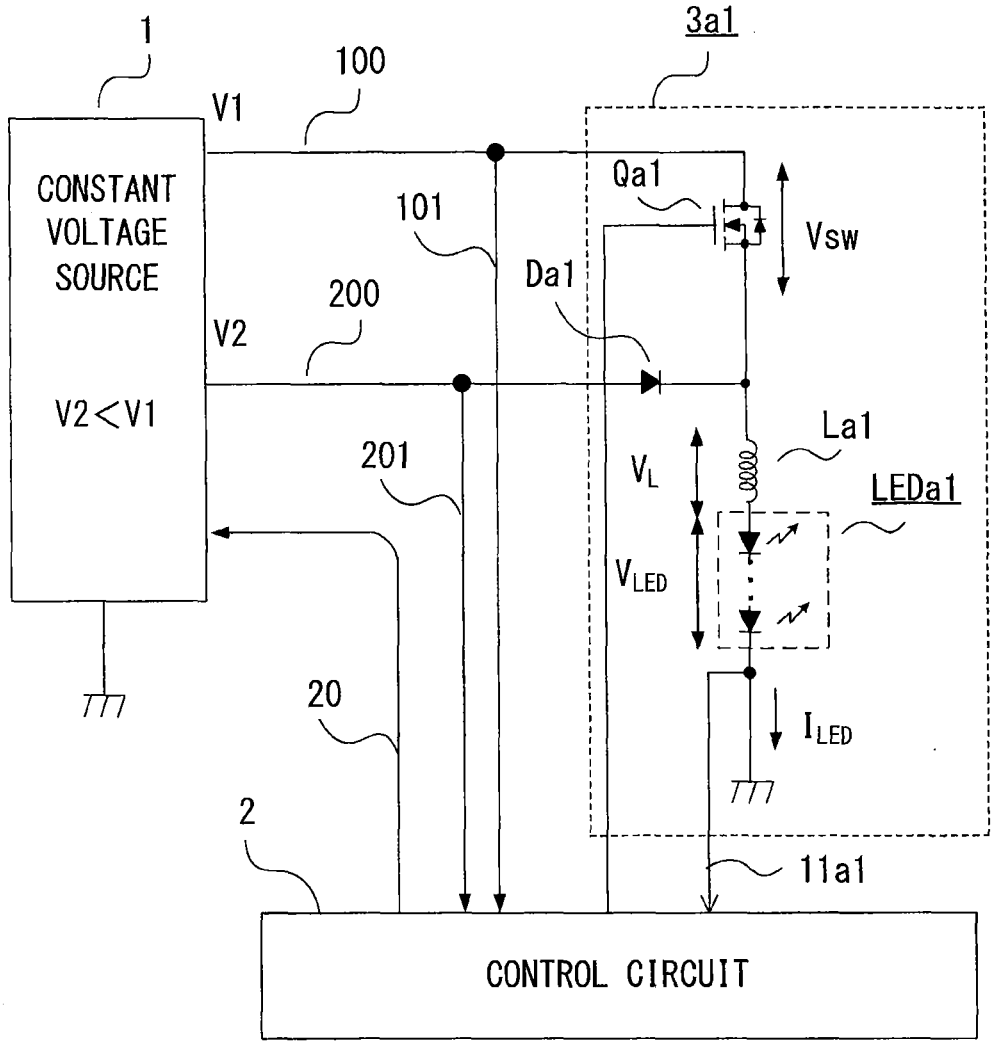
FIG. 12 is a diagram showing the circuit configuration of an LED lighting device according to embodiment 7 of the present invention.
Figure 13:
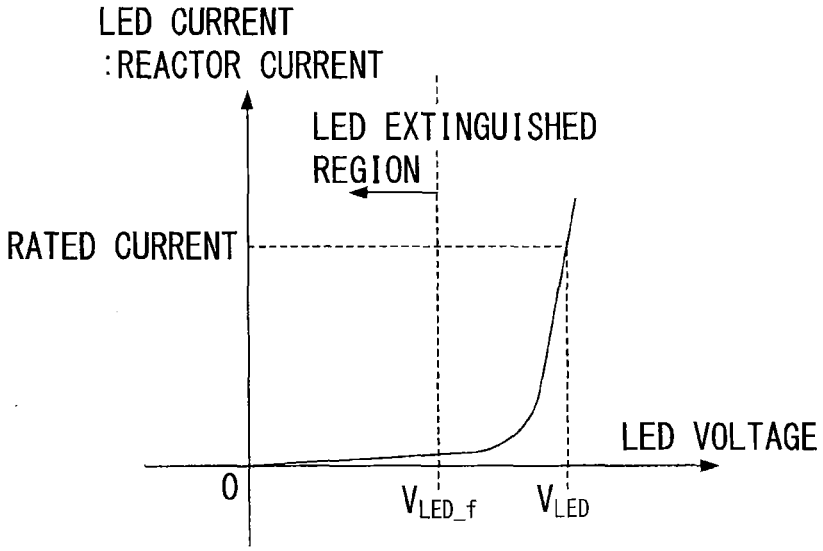
FIG. 13 is a graph showing a static characteristic of an LED unit composing the LED lighting device according to embodiment 7 of the present invention.

Next, an LED lighting device according to embodiment 7 of the present invention will be described based on the drawings. FIG. 12 is a circuit configuration diagram of the LED lighting device according to embodiment 7 of the present invention. In the circuit configuration of embodiment 7 shown in FIG. 12, instead of providing a plurality of LED circuit blocks in parallel in the LED lighting device of embodiment 1 shown in FIG. 1, only one LED circuit block 3*a*1 is provided. The operation of LED lighting device according to embodiment 7 is basically the same as the operation of the LED lighting device according to embodiment 1, so the detailed description thereof is omitted. However, as shown by a static characteristic graph of the LED unit in FIG. 13, since the number of LED units is not plural but one, there is no variation in LED voltage, so only voltage $V_{LED}$ of the LED unit (LEDa1) is the LED voltage. Therefore, the first bus voltage V1, the second bus voltage V2, and the LED voltage $V_{LED}$ when an LED is lit are set so as to satisfy the following relationship obtained by setting $V_{LED}=V_{LED_min}=V_{LED_max}$ in the above expression (1).

$$V2<V_{LED}<V1 \quad (3)$$

The same applies also in the case where only one LED circuit block 3*c*1 is provided in the LED lighting device of embodiment 2 shown in FIG. 6. That is, the first bus voltage V1, the second bus voltage V2, and the LED voltage $V_{LED}$ when an LED is lit are set so as to satisfy the following relationship obtained by setting $V_{LED}=V_{LED_min}=V_{LED_max}$ in the above expression (2).

$$V1-V2<V_{LED}<V1 \quad (3)$$

The same applies also in the other embodiments 3 to 6.

It is noted that, within the scope of the present invention, the above embodiments may be freely combined with each other, or each of the above embodiments may be modified or abbreviated as appropriate.

The invention claimed is:

1. An LED lighting device comprising:

a first bus having first bus voltage;

a second bus having second bus voltage that is lower than the first bus voltage and is higher than a reference potential;

an LED circuit block composed of: a series connection body connected between the first bus and the reference potential and formed by a switching element, a reactor, and an LED unit having one or a plurality of LED elements connected in series; and a diode connected between the second bus and a connection point between the switching element and the reactor; and a control circuit for performing ON/OFF control for the switching element so that LED current flowing in the LED unit is within a rated current range, wherein in the case where the LED unit is lit, voltage applied between both ends of series connection of the reactor and the LED unit becomes the first bus voltage, when the switching element is ON, and becomes voltage that is lower than the first bus voltage and is higher than the reference potential, that is determined based on the first bus voltage and the second bus voltage, when the switching element is OFF, wherein, in each LED circuit block, the switching element, the reactor, and the LED unit are connected in series this order from the first bus side between the first bus and the reference potential, a plurality of the LED circuit blocks are connected in parallel, to the first bus, the second bus and the reference potential, and an anode side of the diode is connected to the second bus, and a cathode side of the diode is connected to the connection point between the switching element and the reactor.

2. The LED lighting device according to claim 1, wherein in the case where each LED unit is lit, the first bus voltage V1 and the second bus voltage V2 are set such that the first bus voltage V1, the second bus voltage V2, and the highest voltage $V_{LED_max}$ and the lowest voltage $V_{LED_min}$ among LED voltages applied to the LED units satisfy the following relationship of:

$$0<V2<V_{LED_min} \text{ and } V_{LED_max}<V1.$$

3. The LED lighting device according to claim 2, wherein the first bus and the second bus are connected to a constant voltage source, and the control circuit controls the first bus voltage or the second bus voltage of the constant voltage source so that the first bus voltage or the second bus voltage becomes the set value.

4. The LED lighting device according to claim 1, wherein in the case where each LED unit is extinguished, each switching element is turned off, and the second bus voltage V2 is set such that the second bus voltage V2, and LED voltage $V_{LED_f}$ when current is small enough that each LED unit is substantially regarded as being extinguished satisfy a relationship of $V2 \leq V_{LED_f}$.

5. The LED lighting device according to claim 1, comprising a first converter and a second converter each connected to an output terminal of a battery, wherein the first converter is connected to the first bus, and the second converter is connected to the second bus, and the control circuit performs control so that output of the first converter becomes the first bus voltage and output of the second converter becomes the second bus voltage.

6. The LED lighting device according to claim 1, comprising a first converter connected to an output terminal of a battery, wherein the first converter is connected to the first bus, and output voltage of the battery is the second bus voltage, and the control circuit performs control so that output of the first converter becomes the first bus voltage.

7. An LED lighting device comprising:

a first bus having first bus voltage;

a second bus having second bus voltage that is lower than the first bus voltage and is higher than a reference potential;

an LED circuit block composed of: a series connection body connected between the first bus and the reference potential and formed by a switching element, a reactor, and an LED unit having one or a plurality of LED elements connected in series; and a diode connected between the second bus and a connection point between the switching element and the reactor; and a control circuit for performing ON/OFF control for the switching element so that LED current flowing in the LED unit is within a rated current range, wherein in the case where the LED unit is lit, voltage applied between both ends of series connection of the reactor and the LED unit becomes the first bus voltage, when the switching element is ON, and becomes voltage that is lower than the first bus voltage and is higher than the reference potential, that is determined based on the first bus voltage and the second bus voltage, when the switching element is OFF wherein a plurality of the LED circuit blocks are connected in parallel, to the first bus, the second bus and the reference potential, and in each LED circuit block, the LED unit, the reactor, and the switching element are connected in series in this order from the first bus side between the first bus and the reference potential, a cathode side of the diode is connected to the second bus, and an anode side of the diode is connected to the connection point between the switching element and the reactor, wherein in the case where each LED unit is lit, the first bus voltage V1 and the second bus voltage V2 are set such that the first bus voltage V1, the second bus voltage V2, and the highest voltage $V_{LED_max}$ and the lowest voltage $V_{LED_min}$ among LED voltages applied to the LED units satisfy the following relationship of:

$$V1-V2<V_{LED_min} \text{ and } V_{LED_max}<V1.$$

8. The LED lighting device according to claim 7, wherein in the case where each LED unit is extinguished, each switching element is turned off, and the first bus voltage V1 and the second bus voltage V2 are set such that the first bus voltage V1, the second bus voltage V2, and LED voltage $V_{LED_f}$ when current is small enough that each LED unit is substantially regarded as being extinguished satisfy a relationship of $V1-V2 \leq V_{LED_f}$.

9. The LED lighting device according to claim 7, wherein the first bus and the second bus are connected to a constant voltage source, and the control circuit controls the first bus voltage or the second bus voltage of the constant voltage source so that the first bus voltage or the second bus voltage becomes the set value.

10. The LED lighting device according to claim 7, comprising a first converter and a second converter each connected to an output terminal of a battery, wherein the first converter is connected to the first bus, and the second converter is connected to the second bus, and the control circuit performs control so that output of the first converter becomes the first bus voltage and output of the second converter becomes the second bus voltage.

11. The LED lighting device according to claim 7, comprising a first converter connected to an output terminal of a battery, wherein the first converter is connected to the first bus, and output voltage of the battery is the second bus voltage, and the control circuit performs control so that output of the first converter becomes the first bus voltage.

* * * * *